US011380270B2

(12) United States Patent
Zhai et al.

(10) Patent No.: US 11,380,270 B2
(45) Date of Patent: Jul. 5, 2022

(54) SIGNAL GENERATION FOR LED/LCD-BASED HIGH DYNAMIC RANGE DISPLAYS

(75) Inventors: Jiefu Zhai, Princeton, NJ (US); Joan Llach, Cesson-Sevigne (FR)

(73) Assignee: INTERDIGITAL MADISON PATENT HOLDINGS, Paris (FR)

( * ) Notice: Subject to any disclaimer, the term of this patent is extended or adjusted under 35 U.S.C. 154(b) by 0 days.

(21) Appl. No.: 13/148,819

(22) PCT Filed: Feb. 9, 2010

(86) PCT No.: PCT/US2010/000359
§ 371 (c)(1),
(2), (4) Date: Nov. 4, 2011

(87) PCT Pub. No.: WO2010/093433
PCT Pub. Date: Aug. 19, 2010

(65) Prior Publication Data

US 2012/0056906 A1 Mar. 8, 2012

Related U.S. Application Data

(60) Provisional application No. 61/151,691, filed on Feb. 11, 2009.

(51) Int. Cl.
*G09G 3/34* (2006.01)

(52) U.S. Cl.
CPC ... *G09G 3/3426* (2013.01); *G09G 2320/0646* (2013.01); *G09G 2360/16* (2013.01)

(58) Field of Classification Search
CPC ..... G09G 3/3426; G09G 2320/0646; G09G 2360/16

(Continued)

(56) References Cited

U.S. PATENT DOCUMENTS 7,154,468 B2 * 12/2006 Linzmeier et al. ..... 345/102
7,567,245 B2 * 7/2009 Mamata ..... 345/207

(Continued)

FOREIGN PATENT DOCUMENTS

EP 1 927 974 A2 6/2008
JP 2002-099250 A 4/2002

(Continued)

OTHER PUBLICATIONS

Feng Li, "66.1: Distinguished Student Paper: Deriving LED Driving Signal for Area-Adaptive LED Backlight in High Dynamic Range LCD Displays", SID 2007 Digest, International Symposium, Society for Information Display, Los Angeles, USA, vol. XXXVIII, May 20, 2007, pp. 1794-1797.*

(Continued)

*Primary Examiner* — Stephen G Sherman
(74) *Attorney, Agent, or Firm* — Ronald Kolczynski

(57) ABSTRACT

A method of operating a high dynamic range display device comprises the steps of: accessing an image signal; generating an intermediate backlighting driver signal for individual backlight elements for a backlighting unit responsive to the image signal; convoluting the intermediate backlighting driver signals with a point spread function of the backlighting unit; deriving at least one new backlighting driver signal responsive to the convoluting step; determining display error associated with a plurality of available light shutter signals of a front-end unit having individual light shutters and associated with the at least one new backlighting driver signal, the front-end unit having a higher resolution than the backlighting unit; driving the display device with a combination of shutter signals and new backlighting driver signals that causes a reduction in the display error with respect to other generated intermediate backlighting driver signals and other available light shutter signals.

3 Claims, 3 Drawing Sheets

(58) Field of Classification Search
USPC ..... 349/61; 345/102
See application file for complete search history.

(56) References Cited

U.S. PATENT DOCUMENTS

| | | | | |
|---|---|---|---|---|
| 2004/0223007 | A1 | 11/2004 | Mamata | |
| 2005/0248553 | A1* | 11/2005 | Feng et al. | 345/204 |
| 2005/0253826 | A1 | 11/2005 | Yang | |
| 2006/0146003 | A1* | 7/2006 | Diefenbaugh et al. | 345/102 |
| 2008/0129677 | A1* | 6/2008 | Li et al. | 345/102 |
| 2009/0002308 | A1 | 1/2009 | Yoshida | |
| 2009/0278867 | A1 | 11/2009 | Brown Elliott et al. | |
| 2010/0060672 | A1 | 3/2010 | Hoppenbrouwers et al. | |

FOREIGN PATENT DOCUMENTS

| | | | |
|---|---|---|---|
| JP | 2008-139871 | A | 6/2008 |
| JP | 2009-14746 | A | 1/2009 |
| TW | 200537413 | | 5/1993 |
| TW | 200807392 | | 2/2008 |
| TW | 200830268 | | 7/2008 |

OTHER PUBLICATIONS

Trentacoste et al., "Photometric image processing for high dynamic range displays", Journal of Visual Communication and Image Presentation, Academic Press, Inc, vol. 18, No. 5, Sep. 5, 2007, pp. 439-451.*

Biemond et al., "Iterative Methods for Image Deblurring", Proceedings of the IEEE, IEEE, New York, vol. 78, No. 5, May 1, 1990, pp. 856-883.*

Feng Li, "66.1: Distinguished Student Paper: Driving LED Driving Signal for Area-Adaptive LED Backlight in High Dynamic Range LCD Displays", SID 2007 Digest, International Symposium, Society for Information Display, Los Angeles, USA, vol. XXXVIII, May 20, 2007, pp. 1794-1797.

Matthew Trentacoste et al., "Photometric image processing for high dynamic range displays", Journal of Visual Communication and Image Presentation, Academic Press, Inc., vol. 18, No. 5, Sep. 5, 2007, pp. 439-451.

Jan Biemond et al., "Iterative methods for image deblurring", Proceedings of the IEEE, IEEE, New York, vol. 78, No. 5, May 1, 1990, pp. 856-883.

Helge Seetzen et al., "High Dynamic Range Display Systems", ACM Press, Aug. 9, 2004, pp. 760-768.

Reinhard et al., "Photographic Tone Reproduction for Digital Images", ACM Trans Graph., vol. 21, No. 3, Jul. 1, 2002, pp. 267-276.

Frédo Durand et al., "Fast bilateral filtering for the display of high dynamic range images", Proc. of SIGGRAPH '02, New York, NY, USA, Jul. 23, 2002, pp. 257-266.

Kate Devlin, "A review of tone reproduction techniques", Tech. Rep., University of Bristol, Nov. 1, 2002, pp. 1-13.

Search Report dated May 6, 2010.

* cited by examiner

SIGNAL GENERATION FOR LED/LCD-BASED HIGH DYNAMIC RANGE DISPLAYS

CROSS-REFERENCE TO RELATED APPLICATION

This application claims the benefit, under 35 U.S.C. § 371 of International Application PCT/US 10/00359, filed Feb. 9, 2010, which was published in accordance with PCT Article 21(2) on Aug. 19, 2010 in English and which claims the benefit of U.S. provisional patent application No. 61/151,691, filed Feb. 11, 2009.

FIELD OF THE INVENTION

The invention is in the field of high dynamic range displays and relates to methods for processing and displaying imagery therein.

BACKGROUND OF THE INVENTION

High dynamic range (HDR) displays are displays that can display imagery with very high contrast, very deep blacks and very bright whites. Such types of displays can show HDR imagery by using non-uniform backlighting. In particular, one can adjust the intensity of the backlighting on different areas of the screen based on the input image.

One of the main challenges for such displays is how to convert the input image from three component data (e.g., RGB, YCbCr) to the four component data required by the displays. This is particularly applicable to displays such as those having a light emitting diode backlighting layer (LED layer) which provides one component in the form of intensity information and an LCD layer which provides three components of intensity and color information.

High dynamic range (HDR) displays have received much attention in the recent years as an alternative format for digital imaging. The traditional Low Dynamic Range (LDR) image format was designed for displays compliant with ITU-R Recommendation BT 709 (a.k.a. Rec. 709), where only two orders of magnitude of dynamic range can be achieved. However, real world scenes have a much higher dynamic range which are around ten orders of magnitude in daytime. The human visual system (HVS) is capable of perceiving 5 orders of magnitude.

These HDR displays have been brought to market in recent years and are based on the so-called LED-LCD technology, where the uniform backlighting of conventional LCD displays is replaced by a matrix of individually controlled LEDs, wherein each LED only illuminates a small area of the screen. The number of LEDs in the LED layer is much smaller than the number of pixels in the LCD layer, but the brightness of each LED can be adjusted over a large range of values. As a result, the LED layer provides a very high dynamic range, low resolution backlighting. The front LCD panel is the same as a convention LCD display, wherein the liquid crystal cells control the color of each pixel and fine-tunes the intensity provided by the LED layer.

In HDR displays, the conversion of three color components of the input image to be converted to four components is not a straightforward process, because there is no simple one-to-one correspondence between the image and the display. Moreover, multiple solutions are possible; as such, finding the optimum solution should be sought, because the various solutions produce various image qualities.

Because HDR displays which have been introduced recently are mostly prototypes (e.g., BrightSide, BrightSide Technologies Inc., 1310 Kootenay Street, Vancouver, B.C., Canada), there has been very little work on the driving signal generation problem. In the original paper pertaining to HDR displays (Seetzen, H., et al., High dynamic range display systems, ACM Press. p. 760-768. 2004), a simple cross-talking method is proposed to reduce the computational complexity. A follow chart of a simple cross-talking methodology is shown in FIG. 1. In FIG. 1, block 101 corresponds to first obtaining an HRD image having intensity character I, block 102 corresponds to determining the target intensities of the backlighting which relates to the square root of the intensity character I, block 103 corresponds to down-sampling the image to the resolution of the backlighting to obtain the actual backlighting signal to use, and block 104 corresponds to obtaining the LCD signal which uses an LCD response function to compensate for backlighting values and the target intensities. This cross-talking method is considerably fast, but the display error is also quite large. It could also fail under large local contrast. In short, displaying an HDR image on such screens is not straightforward, because the lower resolution of the LED layer and the crosstalk between LEDs makes it not possible to individually control the output of each pixel. Using the wrong backlighting results is low image quality and may even lead to visual artifacts such as false contouring and visible LED patterns.

In the paper by Feng Li, Xiaofan Feng, Ibrahim Sezan, Scott Daly, Deriving LED Driving Signal for Area-Adaptive LED Backlight in HDR, SID Symposium Digest of Technical Papers, 38 #1, 1794-1797 (2007), two methods are designed to address this problem. The first method does not take into account display characterization and the human visual system. The second method requires the backlighting to be always brighter than the desired output level and employs a linear optimizer to solve the problem. It has much higher complexity and the assumptions may not practical.

In light of the above mentioned problems, a need exists to develop high dynamic range displays and methods related to processing and displaying imagery therein to ensure that HDR displays comply with the ITU-R Recommendation BT 709 standard, are commensurate with HVS, and do not require and/or use overly computational complex signal processing.

SUMMARY OF THE INVENTION

A display device comprises a backlighting unit having a matrix of light generating elements; a front-end unit having a plurality of light shutters grouped into a repeat arrangement which include at least two different shutters that each attenuate different color light; a signal handling system for receiving image signals and having an algorithm to process the image signals and derive final backlight driver signals for the backlighting unit and final front-end driver signals for the front-end unit, wherein the algorithm can be an iterative gradient descent algorithm. The algorithm can employ at least one difference reduction iteration to derive the final driver signals and at least one iteration can be responsive to a display target image brightness values (I); at least one projected image brightness values (O) correlating to at least one set of intermediate driver signals; and the difference between the brightness values. The algorithm can include: an convolution between a point spread function of the backlighting unit and backlight driver signals, wherein the backlight driver signals can be quantized; can produce or access a backlight matrix L of backlight driver signals for the backlighting unit having M rows by N columns that correspond to the light generating elements and a point spread matrix P that corresponds to the point spread function; and a product of L and P that yields a full resolution backlighting brightness matrix B; and can be adapted to generate the final front-end driver signals for a color p responsive to a product of the brightness matrix and a normalized front-end driver signal for the color p. At least a term of display output brightness Op for a given color p is expressed as a function of the brightness matrix B, an input high dynamic range image for the color p Ip, and a front-end driver signal for the color p Dp, which can be normalized. The display device can optimize the final driver signals by having the algorithm performing least square of the difference calculations between the input high dynamic range image and the display output brightness for the color p and minimizing the least squares. The algorithm can further be adapted such that output error is generated and used in determining the final front-end driver signals for a color p and the output error incorporates at least a term Jp which is a function of an input high dynamic range image brightness Ip for the color p, a normalized front-end driver signal for the color p Dp, a display output brightness Op, and a product of L and P. The algorithm can further determine and/or be responsive to clipping and quantization errors in optimizing final driver signals. The algorithm can further determine and reduce collective output errors that incorporates at least a term $J=\|I_r-O_r\|_2^2+\|I_g-O_g\|_2^2+\|I_b-O_b\|_2^2$ in which the Is are an input high dynamic range image brightness for three colors r, g, and b and the Os are a display output brightness for the three colors, respectively, and the algorithm can use the collective output errors in determining the final front-end driver signals for at least three colors.

A method of operating a high dynamic range display device comprises the steps of: accessing an image signal; generating an intermediate backlighting driver signal for individual backlight elements for a backlighting unit responsive to the image signal; convoluting the intermediate backlighting driver signals with a point spread function of the backlighting unit; deriving at least one new backlighting driver signal responsive to the convoluting step; determining display error associated with a plurality of available light shutter signals of a front-end unit having individual light shutters and associated with the at least one new backlighting driver signal, the front-end unit having a higher resolution than the backlighting unit; driving the display device with a combination of shutter signals and new backlighting driver signals that causes a reduction in the display error with respect to other generated intermediate backlighting driver signals and other available light shutter signals. The method can include accessing target display output for the individual shutters from the image signal; using a factor that includes a square root of the target display output, in which the target display output can be normalized, to obtain intermediate backlighting driver signal in the generating step. The method can further include generating a backlight matrix L having M rows by N columns that correspond to the backlight elements; producing a full resolution backlighting brightness matrix B, at least in part, from the matrix L and the matrix P; comparing the full resolution backlighting brightness matrix B to the image signal; and generating diagonal matrices U and V having diagonal elements corresponding to sign(I-PL*) and sign(PL*-I), respectively, wherein matrix L* represents iterations of new backlighting driver signals and I represents the target display output of the image signal, wherein the comparing step and generating diagonal matrices steps can be repeated n times, in which n is a predetermined number of iterations. The matrix L* can be used after the last iteration to determine a final full resolution backlighting. A final light shutter signal to use can be determined in a manner responsive to the final full resolution backlighting. The method can further include determining clipping error and quantization errors, wherein the clipping error is caused by intermediate driver signals for the backlighting unit correlating to insufficient brightness and is the difference between the insufficient brightness and the target display output, and the quantization error is the difference between a brightness quantization level of the front-end unit and the target display output; and applying the clipping error and/or quantization error into a cost function and using the cost function as a factor in determining the display error. The method can also comprise comparing the full resolution backlighting brightness matrix B to the image signal; and using the comparison in the comparing step in determining the display error and selecting combinations of shutter signals and new backlighting driver signals.

BRIEF DESCRIPTION OF THE DRAWINGS

The invention will now be described by way of example with reference to the accompanying figures of which.

DETAILED DESCRIPTION OF THE INVENTION

Figure 1:
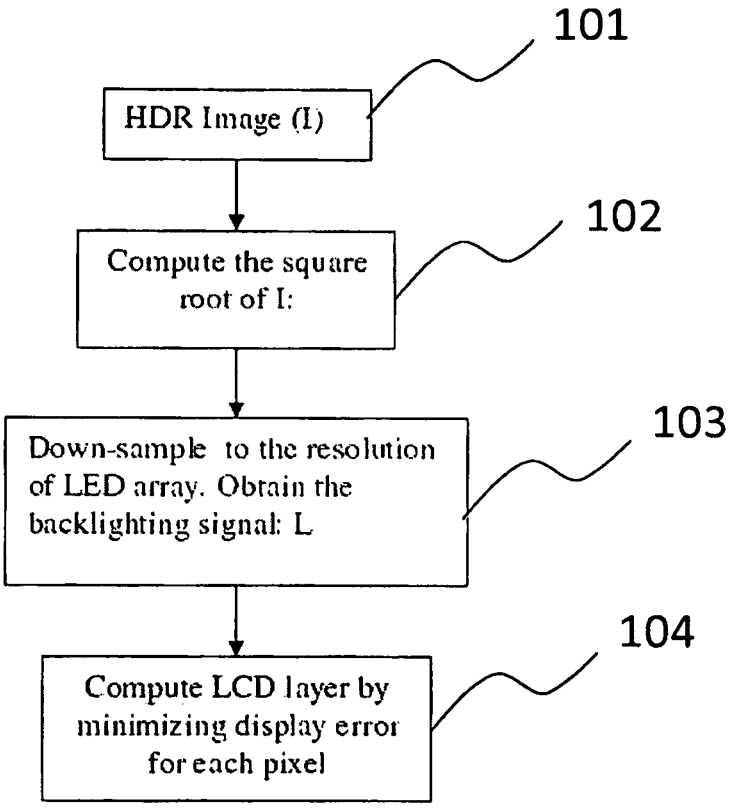
PRIOR ART FIG. 1
FIG. 1 is a block diagram of a method of processing HDR signal for an HDR display according to the prior art.

An approach is disclosed to generate the video signal required to drive HDR displays based on LED-LCD (light emitting diode and liquid crystal display) technology. The proposed approach relies on a mathematical model that characterizes the HDR image and display. For each input HDR image, LED and LCD values are jointly optimized using a display characterization model in order to minimize the difference between the input image (i.e., the ideal output) and the display output. The human visual system (HVS) can also be taken into account in the optimization problem. In an illustrative first embodiment, the optimization is solved by using an iterative method.

In another illustrative embodiment, a simplified scheme with reduced complexity and similar quality is proposed.

In accordance with the principles of the invention, an iterative method is proposed to resolve the LED/LCD optimization problem. The response curve of an LCD can be modeled as an exponential function and the response curve of an LED can be modeled as a linear function. The output of the LED layer of the display can be modeled as the convolution of LED values and a point spread function. A distortion function can defined to provide a measure of the difference between desired output and the actual output, where characteristics of the HVS can be taken into account in this distortion function. By minimizing, the distortion function (e.g., with an iterative gradient descent algorithm), the LED and LCD signals can be obtained.

A simplified version of the proposed algorithm contains only a couple of iterations to reduce the complexity, while maintaining a similar level of quality.

Regarding the HDR device according to the invention, it is important to point out that the display has a pixelated LCD front end panel. Each pixel of the front LCD panel can block light according to its driving signal. In the case of an HDR display, the front LCD panel can be the same as the one in a typical LCD display. The backlighting, however, is non-uniform and of high contrast and high brightness. The backlighting is provided by a regularly arranged matrix of LEDs. The response of a LED can be experimentally obtained by turning on a single LED and measuring the light intensity around it with a photometer. The measured intensity matrix is usually called point spread function in imaging applications. A general model for the backlighting as the convolution between the LED values (quantized values driving the LED layer) and the point spread function of the LEDs. For convenience, this model can be written in matrix form as:

$$B=PL \tag{1}$$

The pixel arrangement of the LCD panel is M rows by N columns, where B and L are vectors of size MN×1. P is the point spread function matrix of size MN×MN. L is the LED matrix, where each element of L equals the normalized LED value, if it corresponds to an LED position or 0 otherwise. Matrix B is the backlighting intensity at each pixel location. Note that these matrices are built for easier formulation; in practice there is no need to construct them. As will be shown later, the matrices of only screen size M×N are used for a more efficient computation.

Once the backlighting is calculated, the LCD layer has to be adjusted so that the output is as close as possible to the input HDR image. To achieve that, a formulation to describe the display output from the previously computed backlighting and the input HDR image is generated and presented as follows:

$$\begin{aligned} O_g &= B \otimes D_g \\ &= \text{sign}(I_g - B) \otimes B + \text{sign}(B - I_g) \otimes (B \otimes D_g) \end{aligned} \tag{2}$$

Here, $O_g$, $I_g$ and $D_g$ are display output (green channel), input HDR image (green channel) and normalized LCD signal (green channel), respectively. (Note that the LCD panels according to the invention may have red, green and blue channels for color display. However, for convenience, the green 'g' component is used, but the same formulation can be used for red and blue.) These are all lexicographically ordered vectors of size MN×1. Note that both input and output signals are linear, not gamma corrected. "$\otimes$" denotes element-wise multiplication. The sign( ) function denotes the element-wise sign function, defined as follows:

$$\text{sign}(A) = B, \text{ where } b_{ij} = \begin{cases} 1 & \text{if } a_{ij} > 0, \\ 0 & \text{otherwise.} \end{cases} \tag{3}$$

Next, an output error is generated. It measures the difference between the ideal output (i.e. the input image) and the actual output (i.e. the displayed image). Based on the previous LED and LCD output models, the following formulation is proposed to compute the square of the difference between the input HDR image and the display output:

$$J_g(L, D_g) = \|I_g - O_g\|_2^2 \tag{4}$$

-continued $$= \begin{pmatrix} \text{sign}(I_g - PL) \otimes (I_g - PL) + \\ \text{sign}(PL - I_g) \otimes (PL \otimes D_g - I_g) \end{pmatrix}^T \times \begin{pmatrix} \text{sign}(I_g - PL) \otimes (I_g - PL) + \\ \text{sign}(PL - I_g) \otimes (PL \otimes D_g - I_g) \end{pmatrix}$$

This equation can be read as follows: for each pixel, if the backlighting is higher than the desired output value (i.e., PL>Ig for a particular pixel), then the error for that pixel is the LCD layer quantization error (i.e. Ig-PL_Dg). (T is in this equation and other equations is the symbol for transposing a matrix.). If the backlighting is lower than the desired output value (i.e. PL<Ig), then the output image is clipped and the LCD cannot increase brightness. In this case, the error is the difference between the ideal output and the clipped value (i.e., Ig-PL).

In the above formulation, vectors L and D are normalized, which means each one of their elements is a real number between 0 and 1. However, in digital systems, L and D have to be quantized. L* and D* and can be defined as the result of applying linear quantization and inverse quantization to L and D. Equation (4) then becomes:

$$\begin{aligned} J_g(L^*, D_g^*) &= \|I_g - O_g\|_2^2 \\ &= \begin{pmatrix} \text{sign}(I_g - PL^*) \otimes (I_g - PL^*) + \\ \text{sign}(PL^* - I_g) \otimes (PL^* \otimes D_g^* - I_g) \end{pmatrix}^T \times \begin{pmatrix} \text{sign}(I_g - PL^*) \otimes (I_g - PL^*) + \\ \text{sign}(PL^* - I_g) \otimes (PL^* \otimes D_g^* - I_g) \end{pmatrix} \end{aligned} \tag{5}$$

As in for equation (2), equations (4) and (5) can be applied to the red 'r' and blue 'b' color components.

The optimization problem is defined as the matrices L* and D*, which stand for quantized LED and LCD vectors, respectively. These need to be optimized to minimize the square of difference between the input HDR image and the display output. Solving this optimization problem directly is very difficult. A simplified approach begins by first reducing the number of variables. Considering sign((PL*-$I_g$) and sign(($I_g$.PL*) are complementary to each other, equation (5) can be rewritten as:

$$\begin{aligned} J_g(L^*, D_g^*) &= \|I_g - O_g\|_2^2 \\ &= \begin{pmatrix} \text{sign}(I_g - PL^*) \otimes (I_g - PL^*) + \\ \text{sign}(PL^* - I_g) \otimes |PL^* \otimes D_g^* - I_g| \end{pmatrix}^T \times \begin{pmatrix} \text{sign}(I_g - PL^*) \otimes (I_g - PL^*) + \\ \text{sign}(PL^* - I_g) \otimes |PL^* \otimes D_g^* - I_g| \end{pmatrix} \end{aligned} \tag{6}$$

Here |•| defines element wise absolute function. In equation (5) the quantization error |PL*$\otimes$ $D_g$-$I_g$| could be approximated by PL*/4q if the quantization error is uniformly distributed, where q is the number of quantization levels of the LCD panel. It has been found that this assumption holds fairly well for natural HDR images. Then, it can be seen that the objective function now depends only on L* in the following equation:

$$J_g(L^*) = (\text{sign}(I_g - PL^*) \otimes (I_g - PL^*) + \text{sign}(PL^* - I_g) \otimes PL^*/4q)^T \times (\text{sign}(I_g - PL^*) \otimes (I_g - PL^*) + \text{sign}(PL^* - I_g) \otimes PL^*/4q) \tag{7}$$

To optimize J, the partial derivative of J over L* can be obtained and used in a gradient descent method to solve the optimization in an iterative manner in the following equation. (The color component will not be indicated in the following to reflect that the equations are applicable to all color components.)

$$L^{*(n+1)} = L^{*(n)} - \lambda\left(\frac{\partial J}{\partial J}\right)\Big|_{L=L^{*(n)}} \tag{8}$$

The right side of equation (7) is non-continuous function, thus the derivative of J can be undefined in some places. To solve the issue, a small λ is chosen such that during one iteration sign(I-PL*) and sign(PL*-I) do not change or only changes slightly. Thus, $L^{*(n)}$ can be changed to sign(I-PL*) and sign(PL*-I) to get a constant vector and simplify the problem. The equation (7) then becomes:

$$J_{n+1}(L^*)=(U(I-PL^*)+VPL^*/4q)^T(U(I-PL^*)+VPL^*/4q) \tag{9}$$

Here, U and V are diagonal matrices with their diagonal elements equal to sign(I-PL*) and sign(PL*-I), respectively. This helps to eliminate the element-wise multiplication and makes it easier to compute the partial derivative. In each iteration, the object function is updated, and then partial derivatives are computed according to equation (8). The extended form of equation (8) can be written as follows:

$$L^{*(n+1)} = L^{*(n)} - \lambda\left(\left(\left(\frac{V}{4q} - U\right)P\right)^T\left(\left(\frac{V}{4q} - U\right)PL^{*(n)} + UI\right)\right) \tag{10}$$

Figure 2:
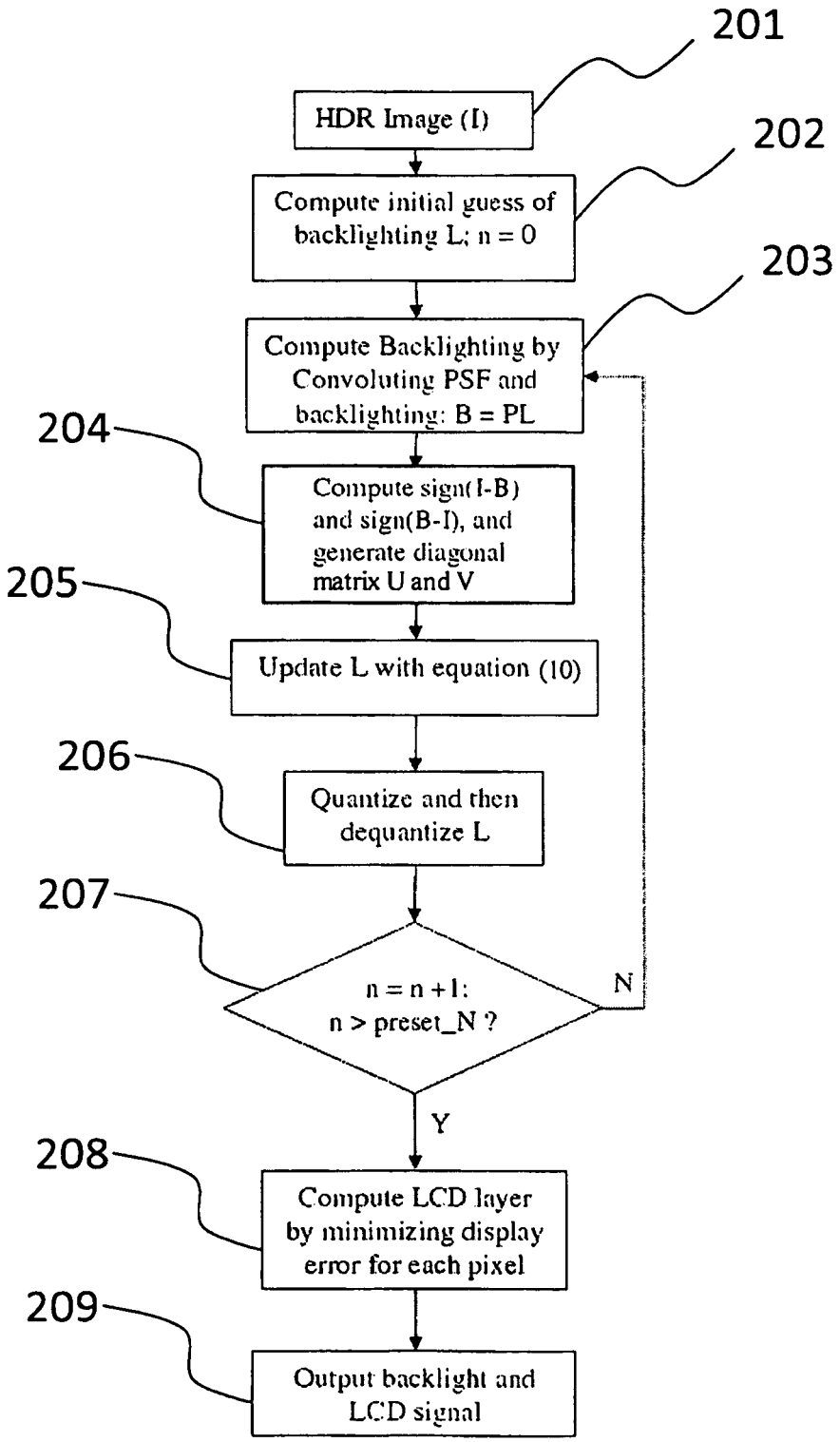
FIG. 2 is a block diagram of a method according to the invention.

The above equation describes how to update L* on each iteration. The procedure to compute L* and D* is shown FIG. 2 and is as follows:

Step 1. In block 201, an HDR image having intensity character I is first obtained.

Step 2. In block 202, an initial guess or estimate for backlight or LED values L* is obtained. The method for obtaining the initial estimate is to first consider the intensity of light that would be needed for the closest backlight element or LED element or the like for the give front-end element (pixel). In sum, this estimate could be the method in FIG. 1. Here, this can be setting the estimate to a value that corresponds to the square root of the normalized output image intensity or the like.

Step 3. In block 203, a convolution of the backlight or LED values with a point spread function characteristic of the backlighting unit is performed to get the full resolution backlighting, $B=PL^{*(n)}$.

Step 4. In block 204, the full resolution backlighting is compared to the input HDR image and matrices U and V are computed.

Step 5. In block 205, the backlight or LED values L are determined with equation (10).

Step 6. In block 206, the backlight or LED values L* are obtained by quantizing L. Dequantization in the chart is the process of going from discrete or digitized values to continuous values.

Step 7. In block 207, n is set to n+1. If (n>preset_η), then the process advances to step 8. If preset value of η is not yet reached, then further processing is performed in blocks 203 through 207 until the preset value is reached.

Step 8. In block 208, with L* being known and fixed, the final full resolution backlighting PL* is computed. For each pixel i, if the backlighting $PL^*_i$ is larger than input HDR image $I_i$, the $D^*_i$ for the LCD front-end is set to its maximum value. If the backlighting $PL^*_i$ is not larger than input HDR image $I_i$, the best $D^*_i$ is chosen to minimize the difference. Note that this applies to all color components.

Step 9. In block 209, the resultant $D^*_1$ and backlighting are employed.

Some of the key features of the invention include the cost function (i.e. equation 4). Here the pixels are categorized into two groups depending on whether backlighting is larger than input image. Quantization error and clipping error are both taken into account in the cost function. Further, there is simplification of the cost function by using the approximation of quantization (i.e. equation 6). The simplification of the cost function is assumed by providing that the sign vectors remain constant during one iteration (i.e. equation 9).

Embodiments of the invention include optimizing LED values for more than one color component. If the three color components are used, equation (4) would become:

$$J(L,D)=\|I_r-O_r\|_2^2+\|I_g-O_g\|_2^2+\|I_b-O_b\|_2^2 \tag{11}$$

In the cost function, $L_p$ norm can be used instead of $L_2$ norm:

$$J(L,D)=\|I-O\|_p^p \tag{12}$$

Here, the $L_p$ norm is defined as:

$$\|A\|_p = \sqrt[1/p]{\sum_i A_i^p} \tag{13}$$

The $L_1$ norm is of special interest because it has a close-form solution and usually more stable and can be expressed as:

$$J(L,D)=\|I-O\|_1^1=|I-O| \tag{14}$$

In this case, L* is updated as follows:

$$L^{*(n+1)} = L^{*(n)} - \lambda\left(\left(\left(\frac{V}{4q} - U\right)P\right)^T \operatorname{sign}\left(\left(\frac{V}{4q} - U\right)PL^{*(n)} + UI\right)\right) \tag{15}$$

In the cost function, the human vision system can be taken into account by considering the relative error rather than absolute error. One can define diagonal matrix F of size MN×MN, whose diagonal elements equal to the inverse of elements of vector I, as:

$$F_{i,i} = \frac{1}{I_i} \tag{16}$$

$$F_{i,j} = 0$$

$$\text{for } 1 \neq j$$

Then the cost function could be rewritten as follows:

$$J_g(L^*)=(FU(I-PL^*)+FVPL^*/4q)^T(FU(I-PL^*)+FVPL^*/4q) \tag{16}$$

This cost function could be optimized in a similar way as equation (9).

Figure 3:
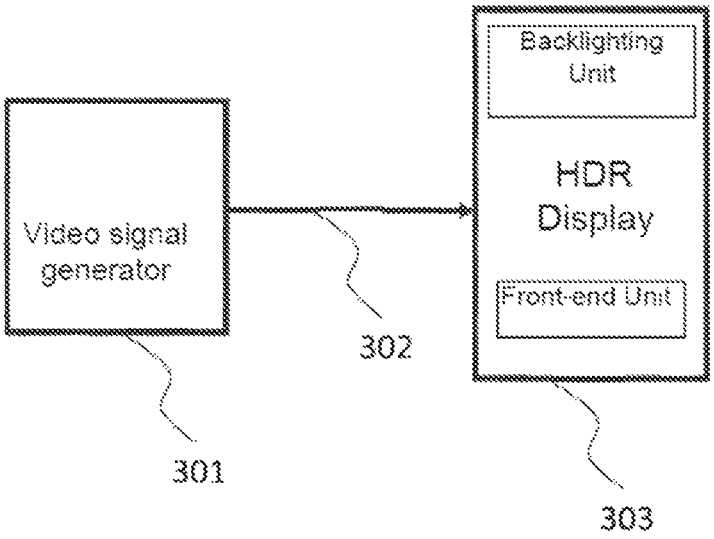
FIG. 3 is a block diagram of an HDR system according to the invention.

In accordance with the principles of the invention, an HDR display system is herein disclosed. This is generally shown in FIG. 3, wherein the system includes a video signal generator 301 that receives input images and generates video or driver signals 302 as described above for driving an HDR display 303. The HDR display can include an LED backlighting unit; however, the invention does include and is applicable for displays having backlighting units with arrays of other types light generating sources. Furthermore, the HDR display can include an LCD front-end; however, the invention does include and is applicable for displays having front-end units with arrays of other types light shuttering or attenuating elements.

In view of the above, the foregoing merely illustrates the principles of the invention and it will thus be appreciated by those skilled in the art to devise numerous alternative arrangements which, although not explicitly described herein, embody the principles of the invention and are within its spirit and scope.

The invention claimed is:

1. A display device comprising:

a backlighting unit having an array of light generating elements;

a front-end unit having a plurality of light shutters grouped into a repeat arrangement which include at least two different shutters that each attenuate different color light;

a video signal generator adapted to receive image signals that contain display target image brightness values (I);

wherein the video signal generator is configured to process the image signals and derive final backlight driver signals for the backlighting unit and final front-end driver signals for the front-end unit, wherein the video signal generator uses a difference reduction iteration to derive the final backlight driver signals and the final front-end driver signals, the difference reduction iteration is responsive to the display target image brightness values (I); at least one projected image brightness value (O) correlating to computed display brightness output values associated with at least one set of intermediate driver signals for the backlighting unit and the front-end unit, the intermediate driver signals for the backlighting unit and the front-end unit being considered settings capable of achieving the display target image brightness values (I); and a difference between the display target image brightness values and the at least one projected image brightness value (O) to derive the final backlight driver signals and the final front-end driver signals; and the video signal generator is adapted to be responsive to a clipping error and a quantization error, wherein:

the clipping error is caused by any of the at least one set of intermediate driver signals for the backlighting unit correlating to an insufficient brightness and is a difference between the insufficient brightness and the display target image brightness values, the insufficient brightness being a brightness level that is less than the display target image brightness values, and the quantization error is a difference between a brightness quantization level of the front-end unit and the display target image brightness values.

2. The display device of claim 1, wherein the difference reduction iteration derives the final backlight driver signals and the final front-end driver signals by an iterative gradient descent in which a minimized square of a difference between the display target image brightness values (I) of an image signal and a final display output brightness associated with the final backlight driver signals and the final front-end driver signals is determined and used to select the final backlight driver signals and the final front-end driver signals; wherein the iterative gradient descent employs a partial derivative of squares of the difference between the display target image brightness values (I) and the at least one projected image brightness value over quantized and normalized brightness values of the backlighting unit.

3. The display device of claim 1, wherein, the intermediate driver signals for the backlighting unit are quantized to be quantized backlight driver signals; and the difference reduction iteration derives the final backlight driver signals and the final front-end driver signals by a convolution between a point spread function of the array of light generating elements of the backlighting unit and the quantized backlight driver signals.

* * * * *